US009393464B2

(12) United States Patent
Iwata

(10) Patent No.: US 9,393,464 B2
(45) Date of Patent: Jul. 19, 2016

(54) GOLF CLUB HEAD AND GOLF CLUB

(71) Applicant: Posting Co., Ltd., Kirishima-shi, Kagoshima (JP)

(72) Inventor: Masatoshi Iwata, Kagoshima (JP)

(73) Assignee: Posting Co., Ltd., Kagoshima (JP)

( * ) Notice: Subject to any disclaimer, the term of this patent is extended or adjusted under 35 U.S.C. 154(b) by 28 days.

(21) Appl. No.: 14/566,189

(22) Filed: Dec. 10, 2014

(65) Prior Publication Data

US 2015/0224372 A1 Aug. 13, 2015

(30) Foreign Application Priority Data

Feb. 10, 2014 (JP) ..... 2014-023229

(51) Int. Cl.
*A63B 53/04* (2015.01)

(52) U.S. Cl.
CPC ..... *A63B 53/04* (2013.01); *A63B 53/047* (2013.01); *A63B 2053/0445* (2013.01)

(58) Field of Classification Search
CPC ..... A63B 2053/0479; A63B 2053/005; A63B 2053/0445
USPC ..... 473/287–292, 324–350
See application file for complete search history.

(56) References Cited

U.S. PATENT DOCUMENTS 2,005,401 A * 6/1935 Storz ..... A63B 53/04 473/331
D327,932 S * 7/1992 Stuff ..... D21/751
5,354,059 A * 10/1994 Stuff ..... A63B 53/04 473/329
5,505,450 A * 4/1996 Stuff ..... A63B 53/04 473/329
6,605,006 B2 * 8/2003 Mason ..... A63B 53/04 473/252
6,814,673 B2 * 11/2004 Wahl ..... A63B 53/047 473/331
7,758,449 B2 * 7/2010 Gilbert ..... A63B 53/047 473/330
7,918,747 B2 * 4/2011 Johnson ..... A63B 53/04 473/328
2002/0049096 A1 4/2002 Doolen
2004/0038745 A1 * 2/2004 Ahlqvist ..... A63B 53/04 473/331
2009/0163290 A1 6/2009 Beaulieu
2009/0318243 A1 * 12/2009 Golden ..... A63B 53/04 473/331

FOREIGN PATENT DOCUMENTS

JP 2002-360750 A 12/2002
JP 2007-307095 A 11/2007

* cited by examiner

*Primary Examiner* — Nini Legesse

(74) *Attorney, Agent, or Firm* — Nakanishi IP Associates, LLC

(57) ABSTRACT

A golf club head includes at least one second score line that is formed such that when a lie angle in a first state where a sole portion is horizontal or substantially horizontal is defined as a first lie angle, the second score line is parallel to a horizontal plane in a second state where a second lie angle that is a lie angle greater than the first lie angle is formed.

5 Claims, 12 Drawing Sheets

GOLF CLUB HEAD AND GOLF CLUB

CROSS REFERENCE TO RELATED APPLICATIONS

This application is based on and claims the benefit of priority to Japanese Patent Application No. 2014-023229 filed on Feb. 10, 2014, the contents of which are hereby incorporated by reference in their entirety.

TECHNICAL FIELD

The present invention relates to a golf club head and a golf club.

BACKGROUND ART

Conventionally, the golf club head of a golf club has a plurality of grooves, called score lines, in the face surface thereof.

FIG. 6A and FIG. 6B each show a conventional golf club 100.

The conventional golf club 100 has a plurality of score lines 112 in a face surface 111*a* of a golf club head 111.

The score lines 112 are arranged approximately parallel to a sole portion 111*b*. Accordingly, when a player holds the conventional golf club 100 in such a manner that the score lines 112 are parallel to the horizontal ground G, the ground G and the axis of a shaft 115 make a predetermined lie angle α (the state shown in FIG. 6A).

However, in the conventional golf club 100, the sole portion 111*b* becomes approximately parallel to the ground G, leading to an increase in the length of contact between the sole portion 111*b* and the ground G, which is likely to cause so-called duffing depending on the course conditions.

In order for the sole portion 111*b* not to become parallel to the ground G, as shown in FIG. 6B, the player should hold the golf club 100 in such a manner that a lie angle β, which is greater than the lie angle α, is formed. As a result, resistance upon the impact of the golf club head 111 against the ground G can be reduced. This allows the player to swing the golf club 100 all the way, whereby duffing can be prevented.

However, when a player holds the golf club 100 to make the lie angle β greater than the original lie angle α as shown in FIG. 6B, the score lines 112 may be inclined with respect to the ground G. The score lines 112 are an important region that directly contacts a ball when hit. When the score lines 112 are inclined, this may greatly change the driving direction, driving distance, and post-landing behavior of the ball, making it difficult to control the ball.

Incidentally, prior arts examples in which score lines are not parallel to a sole portion are Japanese Patent Application Laid-open Publication No. 2002-360750 and Japanese Patent Application Laid-open Publication No. 2007-307095

PRIOR ART LITERATURE

Patent Literature

Patent Literature 1 Japanese Patent Application Laid-open Publication No. 2002-360750

Patent Literature 2 Japanese Patent Application Laid-open Publication No. 2007-307095

SUMMARY OF THE INVENTION

One or more embodiments of the present invention provide a golf club head and a golf club, according to which even in the case where a player holds the golf club at a lie angle greater than the original lie angle, the ball can be easily controlled, and the same driving distance as in the conventional case can be obtained.

Embodiment 1

According to one or more embodiments of the present invention, provided is a golf club head comprising at least one score line that is formed such that when a lie angle in a first state where a sole portion is horizontal or substantially horizontal is defined as a first lie angle, the score line is parallel to a horizontal plane in a second state where a second lie angle that is a lie angle greater than the first lie angle is formed.

Embodiment 2

According to one or more embodiments of the present invention, provided is the golf club head according to the embodiment 1, wherein the score line is located at least on a toe side.

Embodiment 3

According to one or more embodiments of the present invention, provided is the golf club head according to the embodiment 2, including a bulging portion that is formed in the same plane as a face surface to bulge from the toe and has the score line.

Embodiment 4

According to one or more embodiments of the present invention, provided is the golf club head according to the embodiment 1, wherein in the face surface, a lower end of the toe is linear.

Embodiment 5

According to one or more embodiments of the present invention, provided is the golf club head according to the embodiment 1, further comprising, in addition to the score line, a score line that is formed to be parallel to the horizontal plane in the first state.

Embodiment 6

According to one or more embodiments of the present invention, provided is a golf club including the golf club head of the embodiment 1 and a shaft connected to the golf club head.

According to the golf club head and the golf club of one or more embodiments of the present invention, even in the case where the golf club is held at a lie angle greater than the original lie angle, the ball can be easily controlled, and the same driving distance as in the conventional case can be obtained.

DETAILED DESCRIPTION OF THE PREFERRED EMBODIMENTS

Hereinafter, best modes for carrying out the present invention will be described with reference to the drawings, etc.

First Embodiment

Figure 1A:
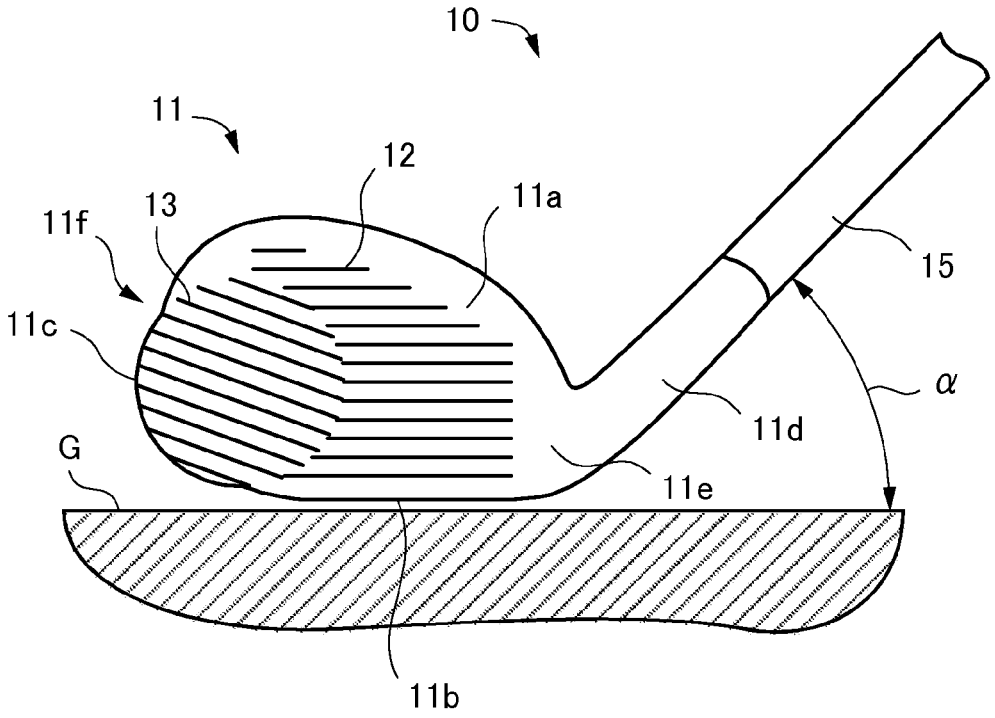
FIG. 1A shows a golf club 10 having a golf club head 11 according a first embodiment of the present invention.
Figure 1B:
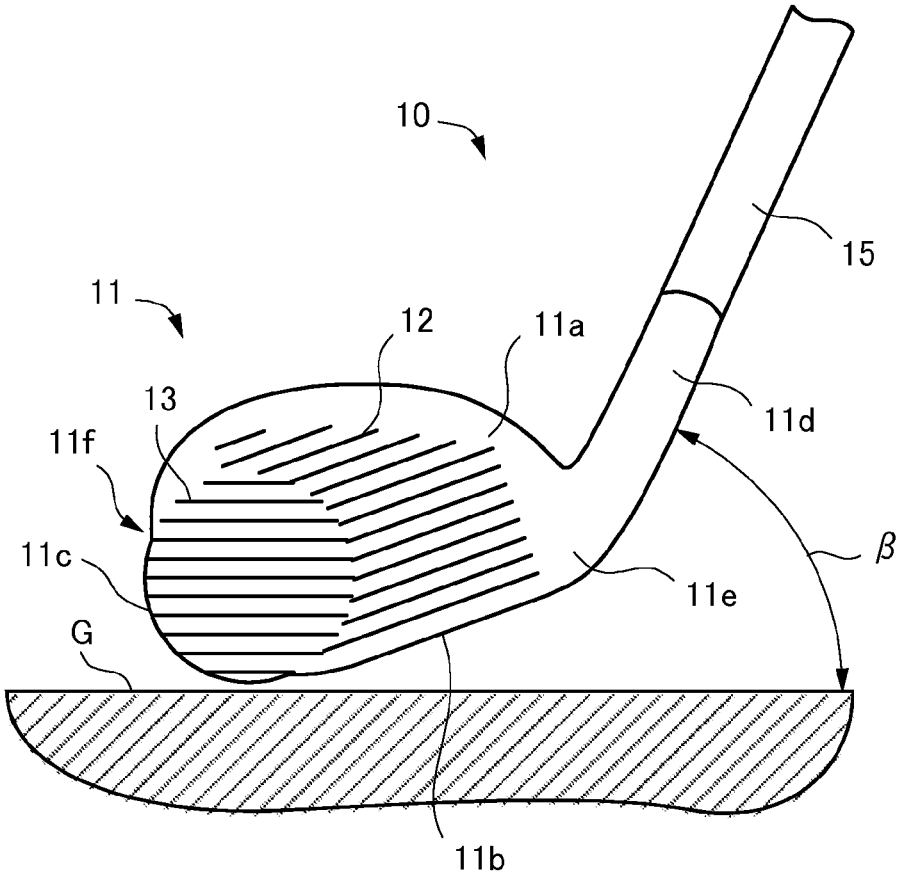
FIG. 1B shows the golf club 10 having the golf club head 11 according the first embodiment of the present invention.

FIGS. 1A and 1B each show a golf club 10 having a golf club head 11 according a first embodiment of the present invention.

Incidentally, the figures referred to below including FIGS. 1A and 1B are schematic figures, and the size and shape of each part are suitably exaggerated to facilitate understanding.

In addition, although explanations will be made showing specific values, shapes, materials, etc., they can be suitably changed.

The golf club 10 of the first embodiment has a golf club head 11 and a shaft 15.

The golf club head 11 includes a face surface 11*a*, a sole portion 11*b*, a bulging portion 11*c*, and a connecting portion 11*d*.

The face surface 11*a* is a surface that hits a non-illustrated ball and is formed to be approximately planar. The face surface 11*a* has formed therein a first score line 12 and a second score line 13. The first score line 12 is located on the side closer to a heel portion 11*e* of the face surface 11*a*. The second score line 13 is located on the side closer to a toe portion 11*f* of the face surface 11*a* in a circular region approximately equal in shape to the outline of a ball. The details of the first score line 12 and the second score line 13 will be described later.

The sole portion 11*b* is the bottom part of the golf club head 11 and extends from the heel portion 11*e* near the shaft 15 to the toe portion 11*f* that is the front end.

The bulging portion 11*c* is formed in the same plane as the face surface 11*a* to bulge from the toe portion 11*f*. Incidentally, the bulging portion 11*c* is formed such that the front end of the bulging portion 11*c* is at a position that is 5 inches or less from the heel portion 11*e* of the golf club head 11. The bulging portion 11*c* has formed therein in the second score line 13.

The connecting portion 11*d* is a part to which the shaft 15 is connected. The part is also called a hosel or neck.

Here, the first score line 12 and the second score line 13 will be described.

The first score line 12 is provided approximately parallel to the sole portion 11B and is a score line that is the same as those provided in conventional golf clubs. That is, in the first state shown in FIG. 1A where the sole portion 11B is horizontal or substantially horizontal, when a player has a swing in such a manner that the first score line 12 is horizontal and a ball is hit against the first score line 12, suitable backspin is applied to the ball, whereby the ball can be driven in a suitable direction. The lie angle in this first state (hereinafter, first lie angle) is defined as $\alpha$. When a player holds the golf club 10 to make the first lie angle $\alpha$, the first score line 12 is horizontal as mentioned above. However, the sole portion 11*b* is also parallel to the ground G, and, therefore, duffing is likely to occur depending on the course conditions, for example.

Thus, in the case where duffing is a concern, the golf club 10 of this embodiment is held by a player to make the second state shown in FIG. 1B. As a result, the ball can be driven in a suitable direction while suppressing duffing. The lie angle in the second state (hereinafter, second lie angle) $\beta$ is an angle greater than the first lie angle $\alpha$. Specifically, the second lie angle $\beta$ should be greater than the first lie angle $\alpha$ by the angle made by the first score line 12 and the second score line 13 (=the angle made by the second score line 13 and a horizontal line in the first state).

When a player holds the golf club 10 to make the second state shown in FIG. 1B, the sole portion 11*b* is off the ground G, and only a part on the toe portion 11*f* side is in contact with the ground G. Specifically, only an end portion of the bulging portion 11*c* is in contact with the ground G. As a result, even when the golf club head 11 hits the ground G during a swing, the region of contact is much smaller than in the first state. As a result, resistance upon the impact of the golf club head 11 against the ground G can be reduced. This allows the player to swing the golf club 10 all the way with full power, whereby duffing can be prevented.

Here, the second score line 13 is formed to be parallel to the horizontal plane in the second state. That is, in the second state shown in FIG. 1B, the second score line 13 extends approximately horizontally. Accordingly, when a player hits a ball with the region in which the second score line 13 is formed, the ball and the second score line 13 contact each other in the same state as in the case of hitting with a conventional golf club. Therefore, even when a player hits a ball in the second state, the ball can be controlled in the same manner as in the conventional case, and the same driving distance as in the conventional case can be obtained.

In addition, in this embodiment, the bulging portion 11*c* is provided to secure a large space as the region in which the second score line 13 is formed. Therefore, in the second state mentioned above, the player can easily hit a ball with the region in which the second score line 13 is formed. Although the this embodiment has been described showing an example in which the bulging portion 11*c* is provided, this is not limitative, and a golf club head having no bulging portion 11*c* is also possible.

As described above, according to the first embodiment, the golf club 10 has the first score line 12 and the second score line 13, and thus is applicable for both use in the conventional manner and use to prevent duffing. Further, with respect to the golf club 10, even when a player holds the golf club 10 in such a manner that a greater lie angle is formed to prevent duffing, because of the second score line 13 that extends approximately horizontally in such a state, the ball can be easily controlled. This is effective also when a player explodes a ball out of a shallow bunker. In addition, even when a player hits a ball with the golf club 10, the same driving distance as in the conventional case can be obtained.

Second Embodiment

Figure 2A:
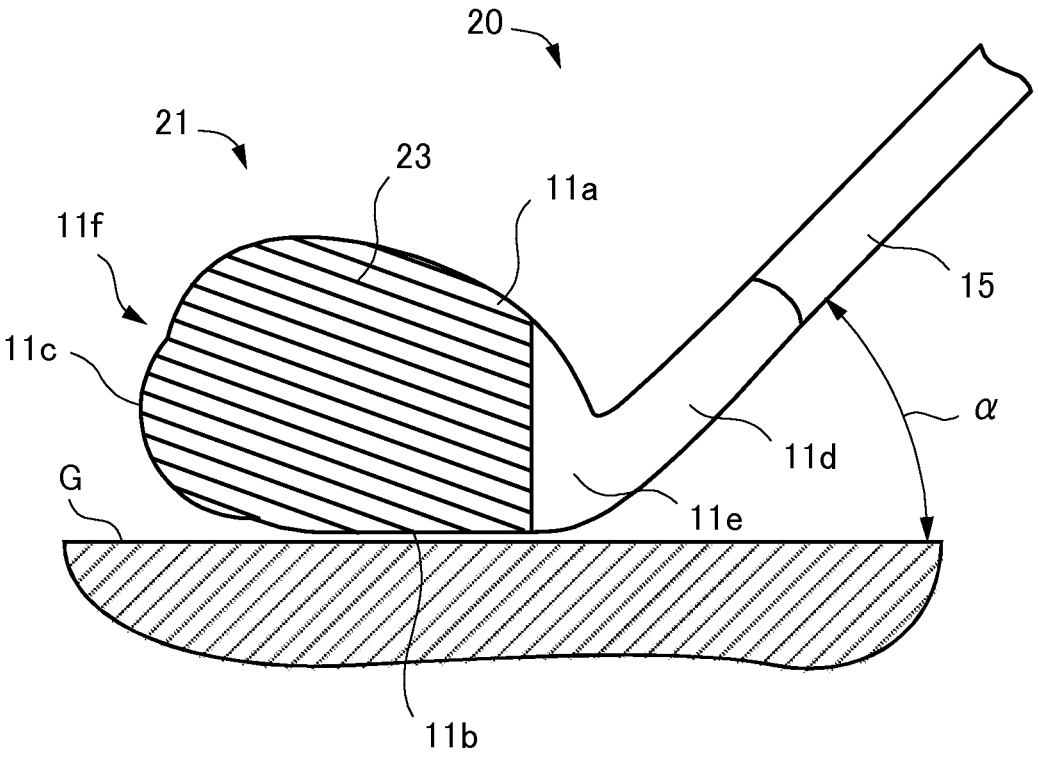
FIG. 2A shows a golf club 20 having a golf club head 21 according to a second embodiment of the present invention.
Figure 2B:
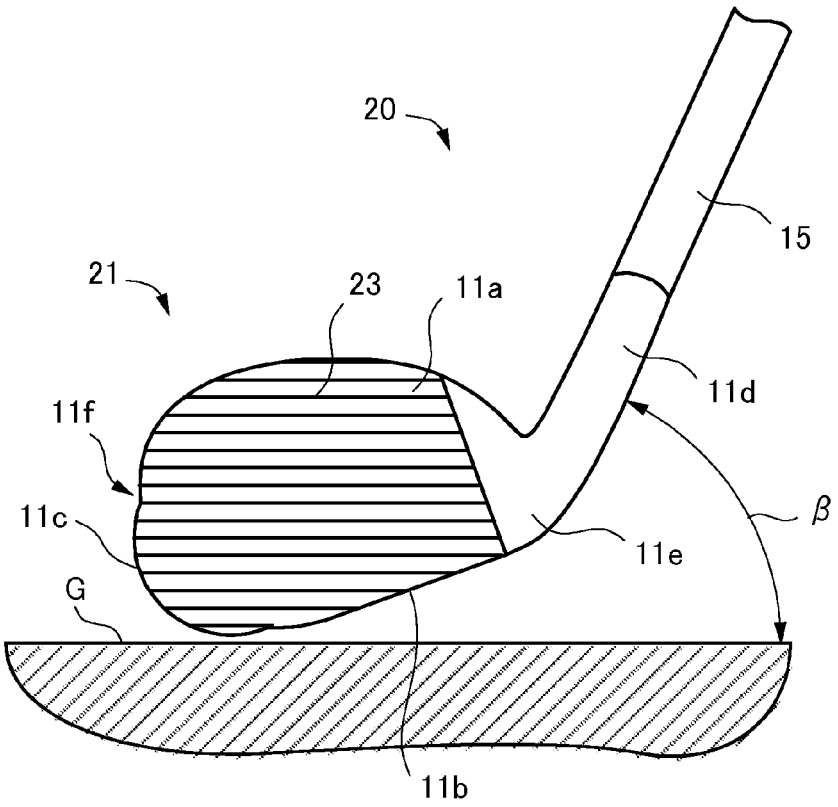
FIG. 2B shows the golf club 20 having the golf club head 21 according to the second embodiment of the present invention.

FIGS. 2A and 2B each show a golf club 20 having a golf club head 21 according a second embodiment of the present invention. FIG. 2A shows a first state, and FIG. 2B shows a second state.

The golf club 20 of the second embodiment has the same configuration as in the first embodiment, except that there is no score line corresponding to the first score line 12 of the first embodiment, and that a second score line 23 is formed over the entire face surface 11*a*. Thus, the parts having the same functions as in the first embodiment are indicated with the same reference numerals, and redundant descriptions are suitably omitted.

The second score line 23 of the second embodiment is formed over the entire face surface 11*a* at the same angle as the second score line 13 of the first embodiment. Accordingly, the golf club 20 of the second embodiment is mainly used in the second state shown in FIG. 2B, where the club is held at a greater lie angle β. In the second state, while preventing duffing, because of the second score line 23 formed over the entire face surface 11*a*, the ball can be easily controlled no matter where in the face surface 11*a* the ball is hit against.

As described above, the golf club 20 of the second embodiment has the second score line 23 over the entire face surface 11*a*, and thus is suitable for use in the second state. Therefore, with the golf club 20 of the second embodiment, the duffing-preventing effect can be more easily obtained.

Third Embodiment

Figure 3A:
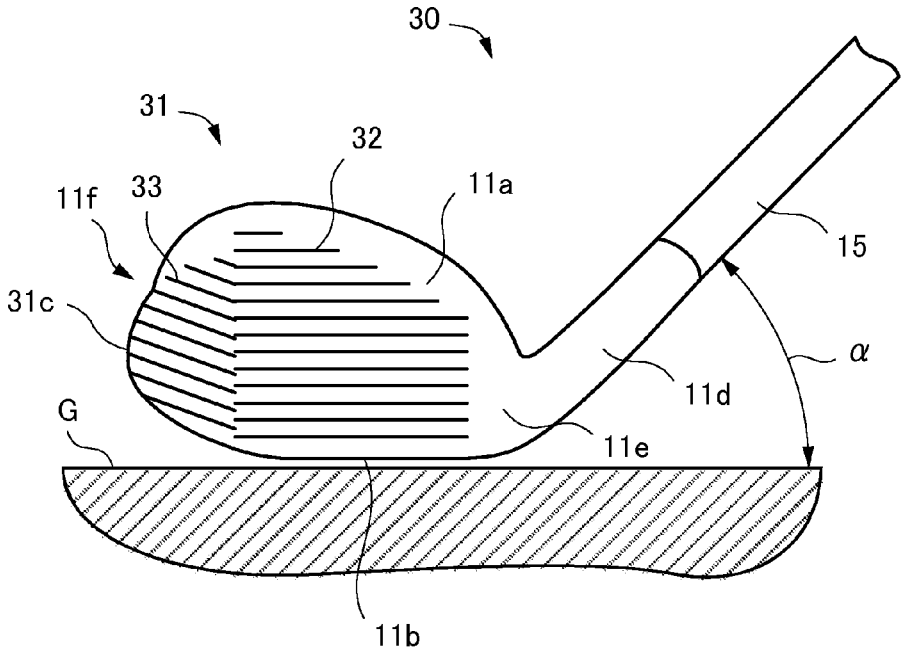
FIG. 3A shows a golf club 30 having a golf club head 31 according a third embodiment of the present invention.
Figure 3B:
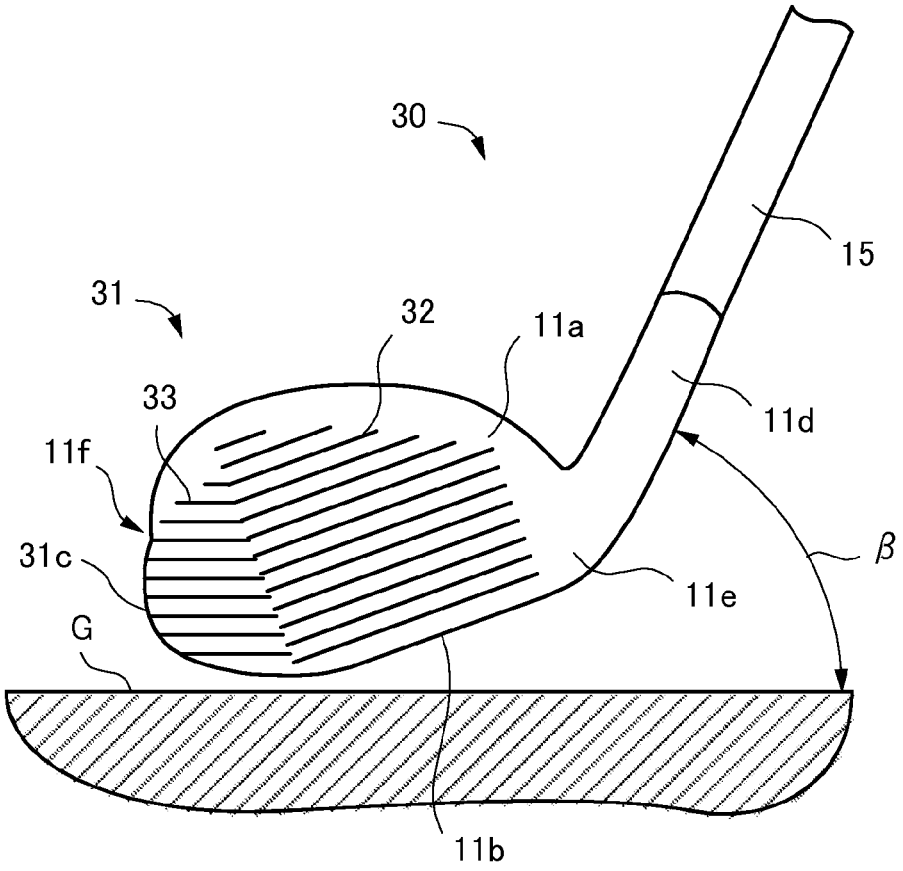
FIG. 3B shows the golf club 30 having the golf club head 31 according the third embodiment of the present invention.

FIGS. 3A and 3B each show a golf club 30 having a golf club head 31 according a third embodiment of the present invention. FIG. 3A shows a first state, and FIG. 3B shows a second state.

The golf club 30 of the third embodiment has the same configuration as in the first embodiment, except that the region where a first score line 32 and a second score line 33 are formed is different from the case of the first score line 12 and the second score line 13 of the first embodiment, and that the shape of a bulging portion 31*c* is different from that of the bulging portion 11*c* of the first embodiment. Thus, the parts having the same functions as in the first embodiment are indicated with the same reference numerals, and redundant descriptions are suitably omitted.

According to the third embodiment, the region of the first score line 32, which is corresponding to the first score line 12 of the first embodiment, is enlarged and formed on the toe portion 11*f* side. Accordingly, the second score line 33, which is corresponding to the second score line 13 located in a circular region approximately equal in shape to the outline of a ball in the first embodiment, is formed in a smaller region than in the first embodiment.

Figure 6A:
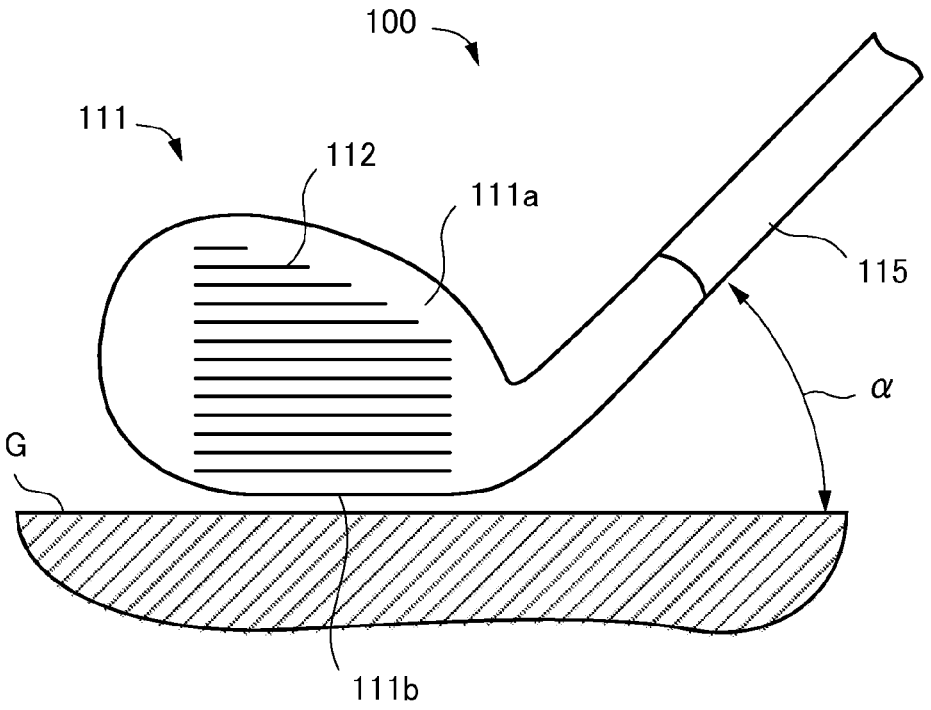
FIG. 6A shows a conventional golf club 100.
Figure 6B:
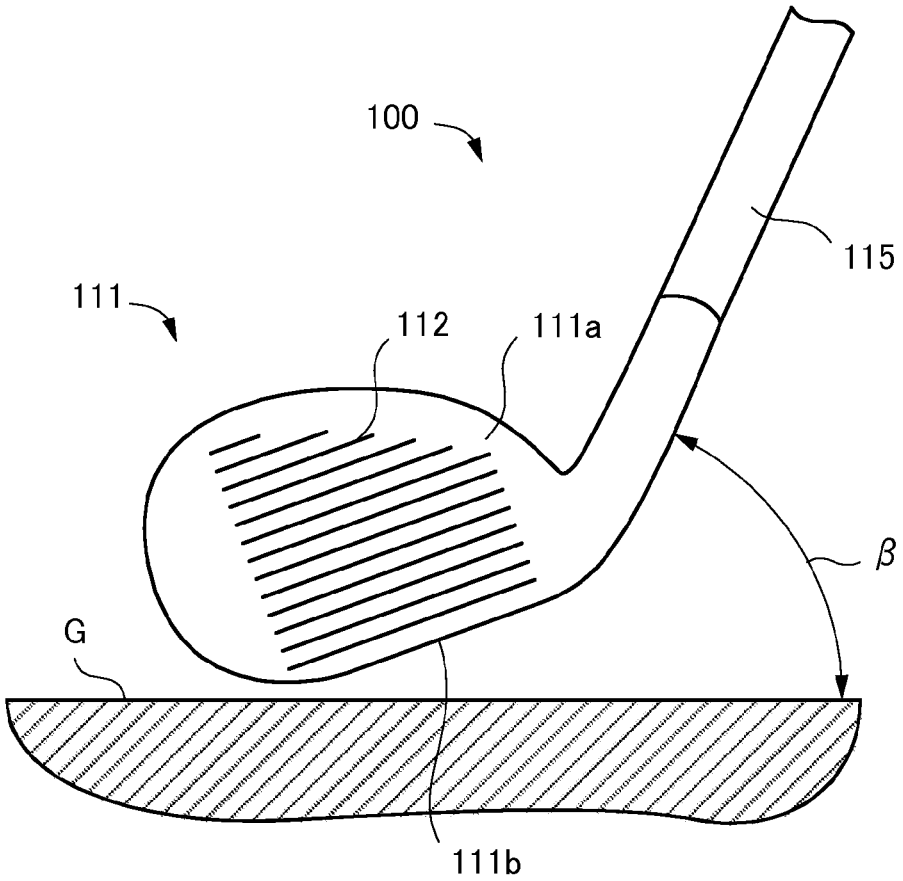
FIG. 6B shows the conventional golf club 100.

In addition, unlike the bulging portion 11*c* of the first embodiment, the bulging portions 31*c* of the third embodiment is formed not to project toward the ground G in the second state but to project only toward the front end of the toe portion 11*f*. In the second state, for some players, the projection of the bulging portion 11*c* of the first embodiment may cause the club to easily get caught by the ground G, inducing duffing, or may give uncomfortable feeling. The bulging portion 31*c* of the third embodiment is suitable for such players. Incidentally, it is also possible that the lower end of the toe portion 11*f* of the third embodiment is linear that it be became to be parallel to the ground G in the second state. In addition, it is also possible that the bulging portion 31*c* of the third embodiment does not project even toward the front end of the toe portion 11*f*, and that the golf club head 31 of the golf club 30 has the same shape as the golf club head 111 of the conventional golf club 100 shown in FIG. 6A and FIG. 6B.

In the golf club 30 of the third embodiment, the region where the first score line 32 is formed is the same as in a conventional golf club. Accordingly, the golf club 30 of the third embodiment can be usually used with exactly the same ease as for conventional golf clubs, and, as necessary, it can also be swung in a manner to suppress duffing. In the case of a swing in a manner to suppress duffing, the ball is hit against the second score line 33. As a result, the player can easily control the ball and also obtain the same driving distance as in the conventional case.

Fourth Embodiment

Figure 4A:
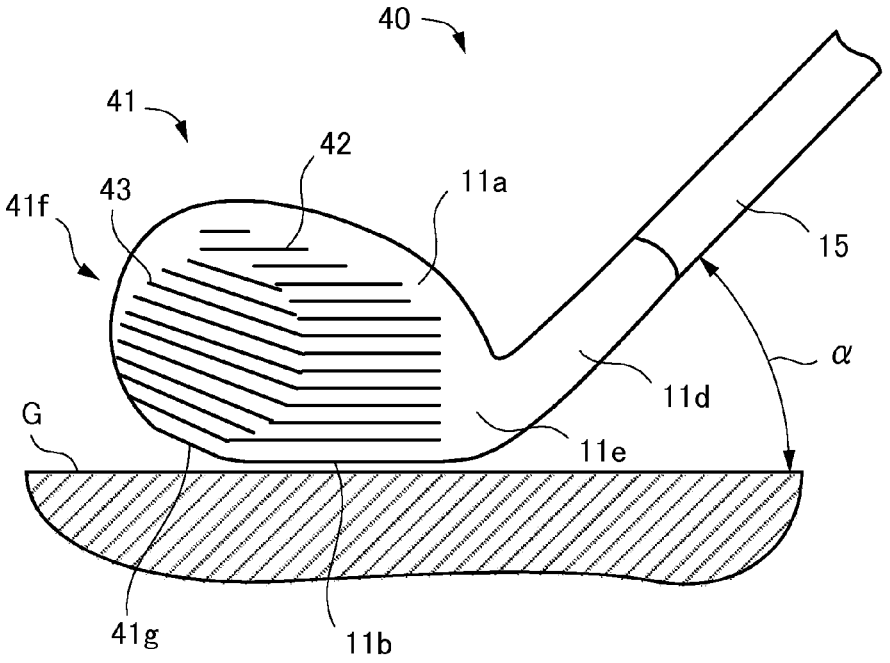
FIG. 4A shows a golf club 40 having a golf club head 41 according a fourth embodiment of the present invention.
Figure 4B:
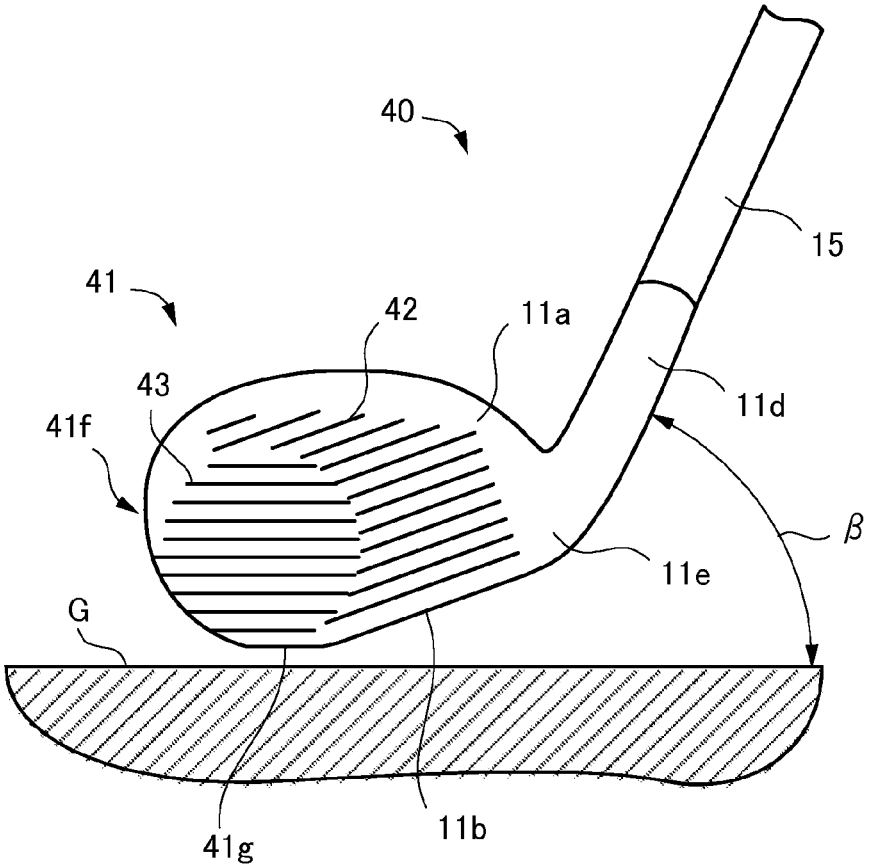
FIG. 4B shows the golf club 40 having the golf club head 41 according the fourth embodiment of the present invention.

FIGS. 4A and 4B each show a golf club 40 having a golf club head 41 according a fourth embodiment of the present invention. FIG. 4A shows a first state, and FIG. 4B shows a second state.

The golf club 40 of the fourth embodiment has the same configuration as in the first embodiment, except that the bulging portion 11*c* of the first embodiment is not provided, and that the lower end of the toe portion 11*f* of the first embodiment is linear. Thus, the parts having the same functions as in the first embodiment are indicated with the same reference numerals, and redundant descriptions are suitably omitted.

Also in the fourth embodiment, like the second score line 13 of the first embodiment, a second score line 43 is located on the side closer to the toe portion 41*f* of the face surface 11*a* in a circular region approximately equal in shape to the outline of a ball. In addition, in the fourth embodiment, the lower end of the toe portion 41*f* is linear, forming a linear portion 41*g*, and the linear portion 41*g* becomes parallel to the ground G in the second state. As a result, in the second state, the lower end of the toe portion 41*f* is less likely to get caught by the ground G, and duffing is less likely to be induced.

As described above, the golf club 40 of the fourth embodiment has the second score line 43 that is located on the side closer to the toe portion 41*f* of the face surface 11*a* in a circular region approximately equal in shape to the outline of a ball, and also has the linear portion 41*g* at the lower end of the toe portion 41*f*. As a result, in the second state, while even more suppressing duffing, the ball can be easily hit against the second score line 43, whereby the player can easily control the ball and also obtain the same driving distance as in the conventional case.

Fifth Embodiment

Figure 5A:
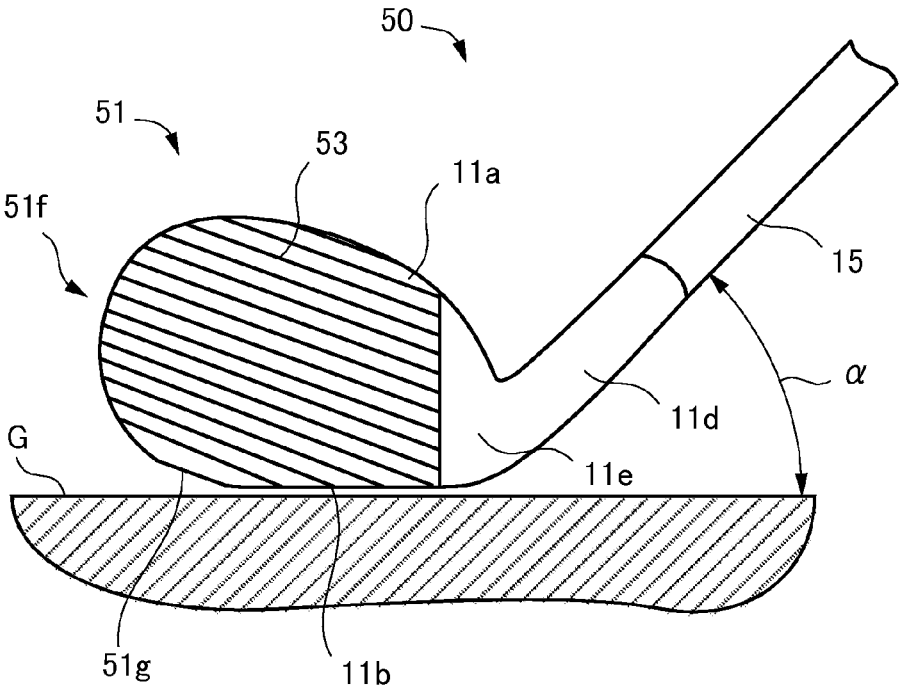
FIG. 5A shows a golf club 50 having a golf club head 51 according a fifth embodiment of the present invention.
Figure 5B:
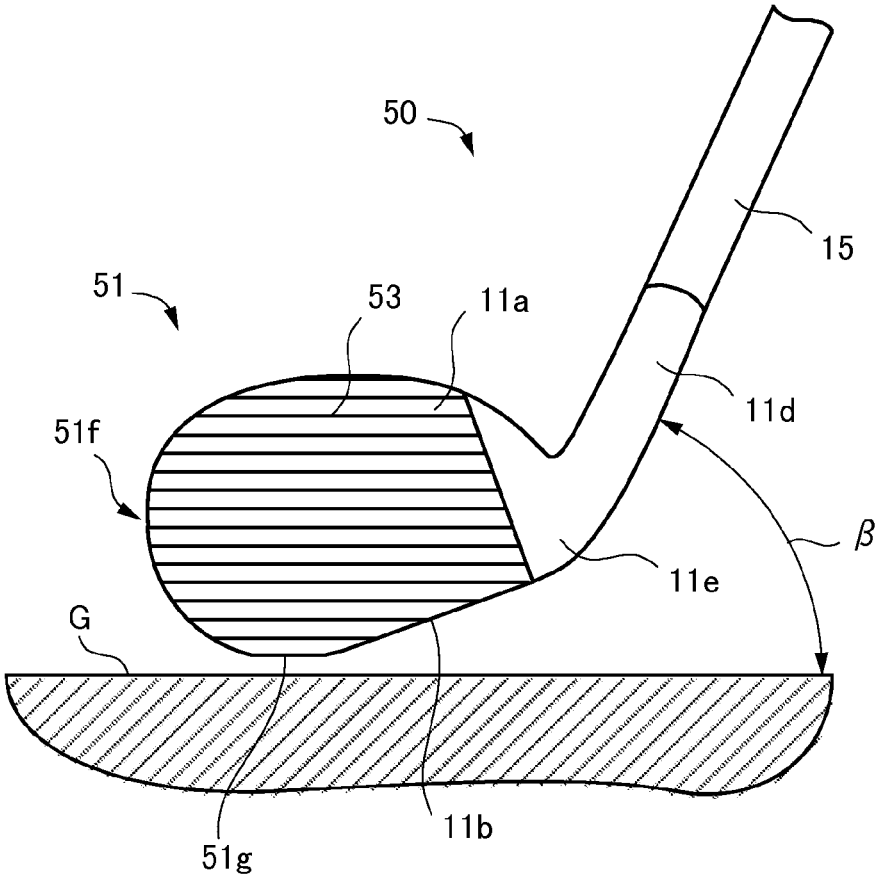
FIG. 5B shows the golf club 50 having the golf club head 51 according the fifth embodiment of the present invention.

FIGS. 5A and 5B each show a golf club 50 having a golf club head 51 according a fifth embodiment of the present invention. FIG. 5A shows a first state, and FIG. 5B shows a second state.

The golf club 50 of the fifth embodiment has the same configuration as in the second embodiment, except that the bulging portion 11*c* of the second embodiment is not provided, and that the lower end of the toe portion 11*f* of the second embodiment is linear. Thus, the parts having the same functions as in the second embodiment are indicated with the same reference numerals, and redundant descriptions are suitably omitted.

The golf club 50 of the fifth embodiment has a second score line 53 over the entire face surface 11*a*, and thus is suitable for use in the second state. In addition, in the golf club head 51 of the golf club 50 of the fifth embodiment, the lower end of the toe portion 51*f* is linear, forming a linear portion 51*g*, and the linear portion 51*g* becomes parallel to the ground G in the second state. As a result, in the second state, the lower end of the toe portion 51*f* is less likely to get caught by the ground G, and duffing is less likely to be induced.

As described above, the golf club 50 of the fifth embodiment has the second score line 53 over the entire face surface

11*a*, and also has the linear portion 51*g* in the lower end of the toe portion 51*f*. As a result, the golf club is capable of suppressing duffing even more and suitable for use in the second state.

Variations

The present invention is not limited to the above embodiments, and various variations and modifications can be made, which are also within the scope of the present invention.

Although each embodiment shows an example in which a large number of each score lines are formed, their number or location can be suitably changed. For example, an embodiment in which the number of second score lines is 1 is also possible.

Incidentally, the first embodiment to fifth embodiments and variations may also be suitably used in combination, but the detailed description is omitted. In addition, the present invention is not limited by the embodiments described above.

DESCRIPTION OF REFERENCE NUMERALS

10 golf club
11 golf club head
11*a* face surface
11*b* sole portion
11*c* bulging portion
11*d* connecting portion
11*e* heel portion
11*f* toe portion
12 first score line
13 second score line
15 shaft
20 golf club
21 golf club head
23 second score line
30 golf club
31 golf club head
31*c* bulging portion
32 first score line
33 second score line
40 golf club
41 golf club head
41*f* toe portion
41*g* linear portion
42 first score line
43 second score line
50 golf club
51 golf club head
51*f* toe portion
51*g* linear portion
53 second score line
100 golf club
111 golf club head
111*a* face surface
111*b* sole portion
112 score line
115 shaft
α first lie angle
β second lie angle
G ground

The invention claimed is:

1. A golf club head comprising:

at least one score line that is formed such that when a lie angle in a first state where a sole portion is horizontal or substantially horizontal is defined as a first lie angle, the score line is parallel to a horizontal plane in a second state where a second lie angle that is a lie angle greater than the first lie angle is formed; and a bulging portion that is formed in the same plane as a face surface to bulge from the toe and has the score line.

2. The golf club head according to claim 1, wherein the score line is located at least on a toe side.

3. The golf club head according to claim 1, wherein in the face surface, a lower end of a toe is linear.

4. The golf club head according to claim 1, further comprising, in addition to the score line, a score line that is formed to be parallel to the horizontal plane in the first state.

5. A golf club comprising the golf club head of claim 1 and a shaft connected to the golf club head.

* * * * *